US005901471A

United States Patent [19]

Warner

[11] Patent Number: 5,901,471

[45] Date of Patent: May 11, 1999

[54] SNOWSHOE FOR RECEIVING CRAMPONS

[75] Inventor: Charles Bently Warner, San Francisco, Calif.

[73] Assignee: Atlas Snowshoe Company, San Francisco, Calif.

[21] Appl. No.: 09/009,948

[22] Filed: Jan. 21, 1998

[51] Int. Cl.[6] ..... A43C 15/06

[52] U.S. Cl. ..... 36/124; 36/7.6; 36/125

[58] Field of Search ..... 36/7.6, 122, 123, 36/124, 125

[56] References Cited

U.S. PATENT DOCUMENTS

| | | |
|---|---|---|
| 4,620,375 | 11/1986 | Wallace . |
| 5,253,437 | 10/1993 | Klebahn et al. . |
| 5,440,827 | 8/1995 | Klebahn et al. . |
| 5,687,491 | 11/1997 | Klebahn . |
| 5,699,630 | 12/1997 | Klebahn et al. . |

OTHER PUBLICATIONS

Morton, Keith "A Review of Outdoor Products", *Explore*, Dec./Jan. 1997/ 98, pp. 79–80.

*Primary Examiner*—M. D. Patterson
*Attorney, Agent, or Firm*—Thomas M. Freiburger

[57] ABSTRACT

A snowshoe is configured to receive a boot-mounted crampon, such that the crampon teeth serve as the front and rear cleats for the snowshoe. Two openings are included in the snowshoe deck, at toe and heel, the toe harness assembly including a plate configured to receive the front portion of a crampon such that the crampon is inserted into the snowshoe with the toe tipped down, then the heel is rotated down to lock the crampon to the plate. A single strap is included to secure the boot to the harness at a location behind the ball of the foot. In a preferred embodiment, left and right portions of the tooth assembly near the toe of the crampon fit closely within a clearance at each side of the plate, so that as the crampon is placed into the plate the crampon becomes located and registered to a certain position, rigidly holding the crampon on the plate against rotation about a vertical axis.

9 Claims, 4 Drawing Sheets

SNOWSHOE FOR RECEIVING CRAMPONS

BACKGROUND OF THE INVENTION

This invention is concerned with snowshoes and in particular with snowshoes adaptable to receive ice crampon in a manner enabling quick and easy conversion from snowshoeing to traversing ice without snowshoes.

Snowshoes in recent years have evolved from the conventional wood frames with rawhide netting serving as a deck, to metal or plastic composite frames with decks of Hypalon or other high strength material, usually wrapped around the frame and riveted. Modern snowshoes usually include cleats for engaging snow or ice, at the toe harness and often at a location under the heel of the boot as well.

In climbing or steep terrain hiking in snowy and icy conditions, the climber often needs to switch from wearing snowshoes on the boots to crampons on the boots, and back to snowshoes as fields of deeper snow are again encountered. To change from ice crampons to snowshoes, the user normally has to release the crampon's bales from front and back of the boot, remove the crampons and stow them in or on a pack, take out a pair of snowshoes from the pack, with their relatively heavy toe harness assemblies and cleats, and secure the snowshoes to the boots using several harness straps. In conditions where deep snow and ice are alternately encountered, the hiker or climber would be much better served if the crampon teeth could serve as the cleats for the snowshoes, and this is a primary object of the invention.

U.S. Pat. No. 4,620,375 disclosed a snowshoe wherein the user's boot was secured to a binding on an ice crampon. The crampon had toe and heel cleats which passed down through openings in toe and heel areas of the snowshoe deck when the user's boot was pivoted to the heel-down position, so that the crampon cleats served as cleats for the snowshoe. A horizontal pivot pin had to be assembled through the snowshoe frame and the crampon binding.

Atlas Snowshoe Company U.S. Pat. No. 5,440,827 described one form of snowshoe/boot combination in which a heel cleat was fixed to the boot heel rather than to the snowshoe deck, which instead had an opening through which the boot heel extended when weight was placed on the heel.

SUMMARY OF THE INVENTION

A snowshoe and crampon combination in accordance with the invention includes a snowshoe having two openings in its deck, at a toe harness area and at a rear cleat area under the heel of the boot. The snowshoe is adapted to receive a crampon secured to a user's boot, in a step-in arrangement affording quick and efficient securement of the boot and crampon to the snowshoe. The crampon's teeth then serve as snowshoe cleats. The snowshoe can quickly be removed from the boot and crampon when ice is again encountered.

The advantages of this snowshoe/crampon system are lighter weight snowshoes when the snowshoes are being carried; and fast and efficient transition from snowshoes to ice crampons and back to snowshoes, as terrain conditions change.

In a preferred embodiment, the snowshoe has a pivoting front harness, which may be biased to the tail-down position of the snowshoe, the front harness comprising a rigid plate adapted to be received against the bottom of the crampon. The rigid plate has a specific shape which is designed to accommodate the pattern of teeth at the front end of the crampon, generally under the toes and the ball of the foot.

The plate has a front portion which provides a closely defined clearance at each side, left and right, for receiving left and right portions of the crampon tooth structure. The clearances are configured and sized such that the user must tip the toe of the boot and connected crampon toe-down to insert the left and right tooth structure into the clearances; then, when the heel is rotated down, an angled front tooth edge pivots under a part of the plate, the tooth structure becomes closely nested in the clearances at both sides, and the front end of the crampon is thus locked in position against lifting from the plate. The configurations of the harness plate, and of the tooth structure, are such that the crampon becomes oriented (with respect to rotation about a vertical axis) on the snowshoe as the teeth are inserted into the clearances and the heel is lowered.

Once the user has stepped the crampon and boot into the snowshoe as described, a single strap is used to secure the boot down to the front harness assembly, preferably located approximately at the boot arch and extending over the top of the foot between the ankle and the ball of the foot. This strap preferably is mounted on the harness plate.

It is thus among the objects of the invention to make more efficient the use of snowshoes and crampons in traversing fields of ice and snow alternatively, by providing a snowshoe with a front harness plate configured to receive a crampon in a step-in maneuver that enables very quick transition from ice trekking to snowshoeing. These and other objects, advantages and features of the invention will be apparent from the following description of preferred embodiments, considered along with the accompanying drawings.

DESCRIPTION OF PREFERRED EMBODIMENTS

Figure 1:
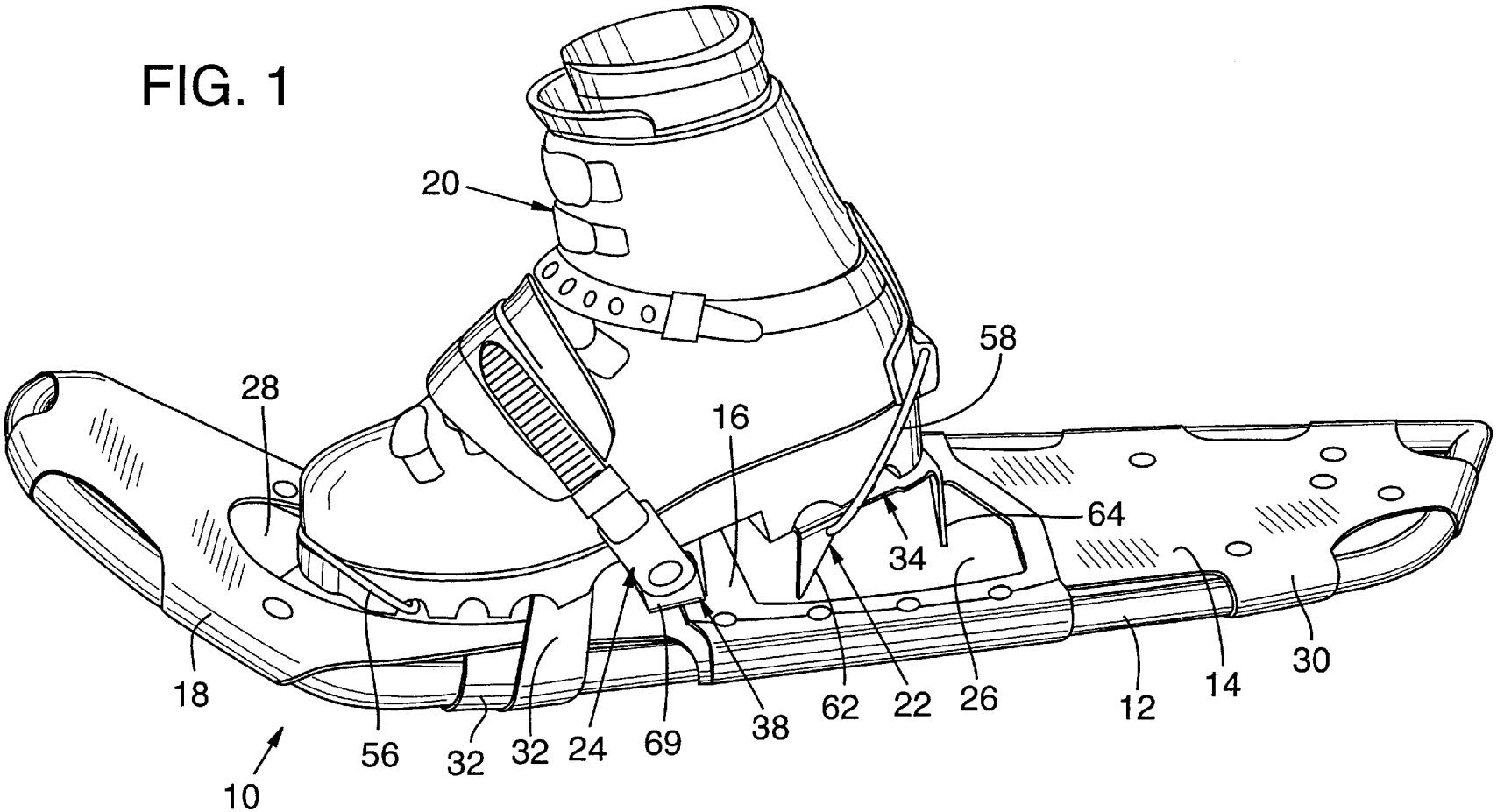
FIG. 1 is a perspective view showing a snowshoe with connected boot and crampon, in accordance with the principles of the invention.

FIG. 1 shows a snowshoe 10 having a frame 12 and deck portions 14, 16 and 18. A boot 20 with an attached crampon 22 is secured to the snowshoe by a front harness assembly of the snowshoe, generally identified by 24. As can be seen in the drawing, the snowshoe deck portions 16 and 18 have relatively large openings 26 and 28, and these accommodate rear and front groups of crampon teeth, as further explained below.

Figure 2:
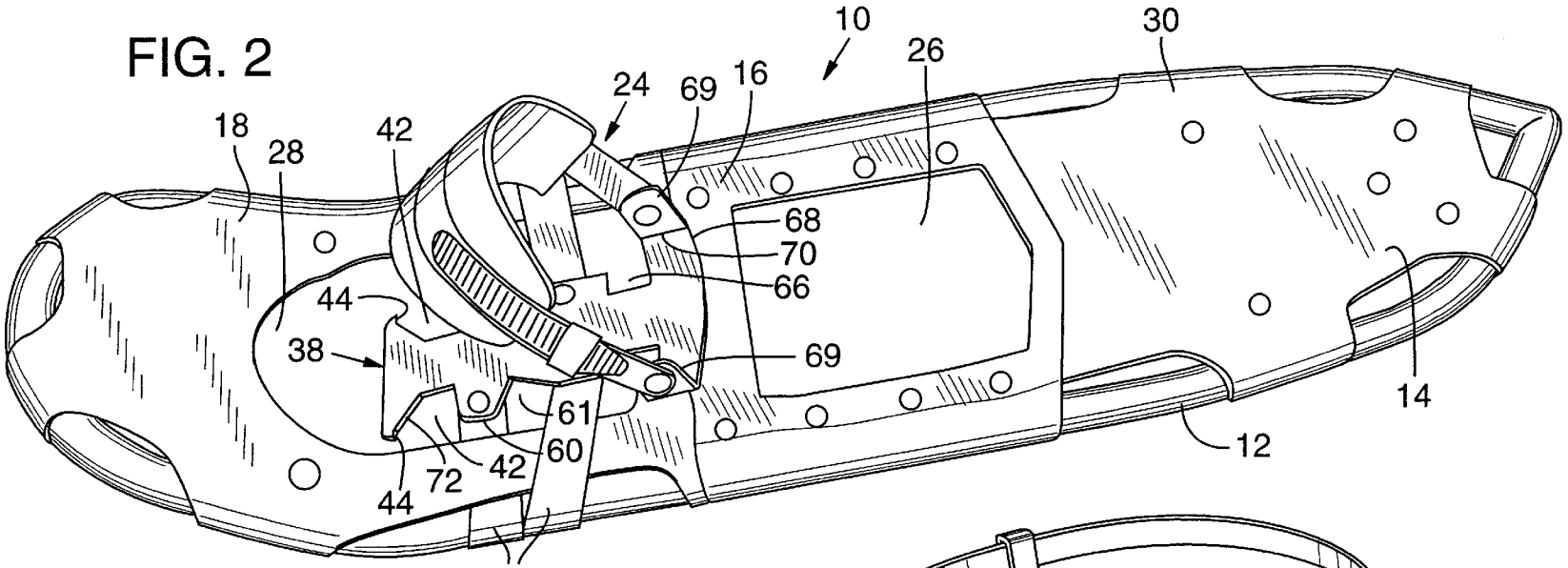
FIG. 2 is a perspective view showing the snowshoe alone.

FIG. 2 shows the snowshoe 10 alone. The decking areas 14, 16 and 18 in this preferred embodiment are retained to the snowshoe frame 12 by sections of decking material which extend around the frame and are riveted together to the main body of decking, as at 30, for example, and as shown in U.S. Pat. No. 5,440,827. The snowshoe's decking can be comprised of fewer pieces if desired.

As FIG. 2 reveals, the snowshoe 10 has a front harness assembly 24, preferably pivotable about a horizontal axis which can be provided by one or more resilient straps 32 wrapped around the frame and retaining the harness assembly preferably in a toe-down biased position, as shown in U.S. Pat. Nos. 5,253,437, 5,440,827, 5,699,630 and 5,687,491. However, the front harness and pivot assembly is without a front claw or cleat, nor does the snowshoe have any rear cleat. Instead, the open areas 28 and 26 provide space for a user wearing a boot and a crampon such as the crampon 22 to step into the snowshoe and lock the crampon to the snowshoe, after which the teeth of the crampon can be used as front and rear cleats for the snowshoe.

Figure 3:
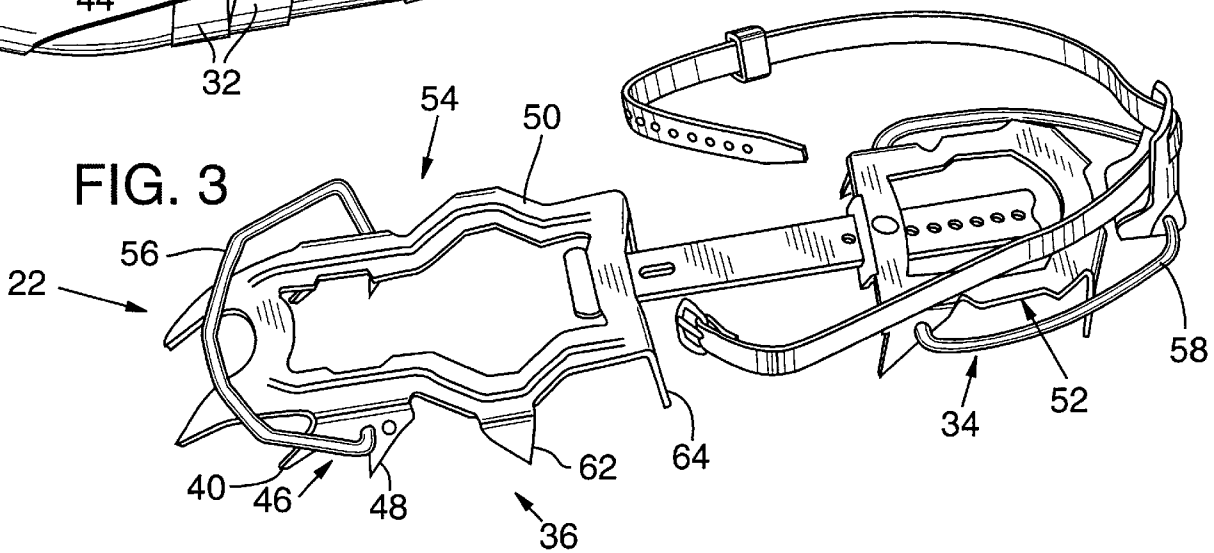
FIG. 3 is a perspective view showing a crampon of a type for use with the snowshoe of the invention.
Figure 6:
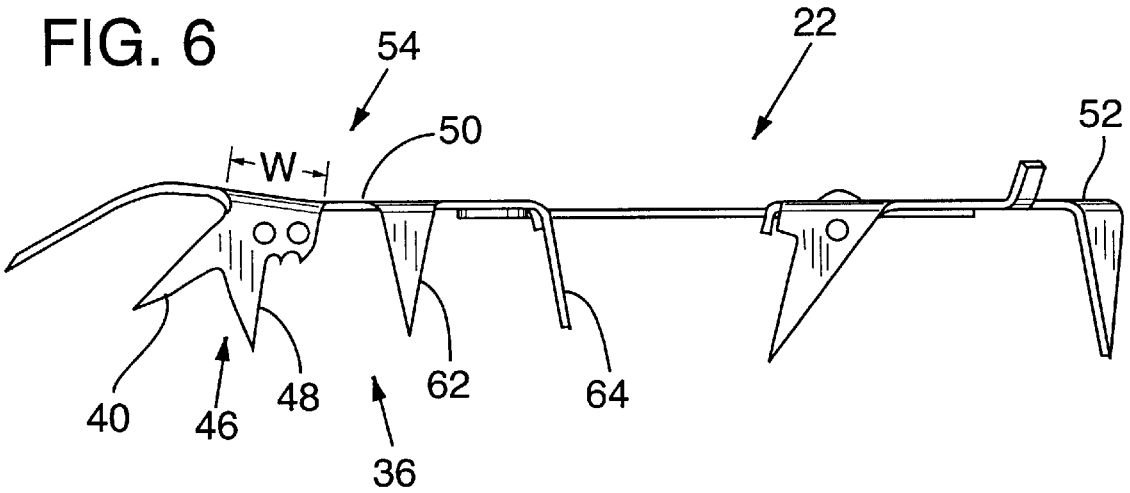
FIG. 6 is a side elevation view of a crampon as in FIG. 3.

FIGS. 3 and 6 show a crampon 22 which is configured for use with the snowshoe of the invention. Important features of the crampon 22 are that its rear group 34 of teeth is positioned to pass through the rear, generally heel-located opening 26 of the snowshoe, that its front group 36 of teeth is positioned to pass through the opening 28 at the front of the snowshoe, and that the front group 36 of teeth be configured to straddle over and engage with a front harness plate 38 which is an important feature of the snowshoe. As seen in FIGS. 2 and 3, the crampon 22 can be attached to the snowshoe via the harness mounting plate 38, by simply stepping into the snowshoe in a toe-down position when the crampon is worn on the user's boot. With the strap assembly 24 in a loosened or released position, the user inclines the boot with the toe downward, at a steeper angle than the orientation of the mounting plate 38 itself, inserting a pair of opposed, left and right side teeth 40 (the left tooth 40 is visible in FIGS. 3 and 6) down through a clearance 42 provided at each side of a front portion of the mounting plate 38. The opposed crampon teeth 40 have inclined front surfaces so as to extend under tip structure 44 at each side of the front end of the mounting plate.

The crampon teeth 40 each comprise a part of a side protrusion 46, which may also include another tooth 48 just behind the tooth 40, and which has a width W (FIG. 6) at its upper end, near a deck or frame 50 of the crampon, which is matched to the length of the clearance 42 in the harness plate 38. The forward side of the tooth 40, that is, of each side protrusion 46, is inclined forwardly/downwardly as shown, so that it engages under the structure 44 of the plate 38 and then locks the crampon in place after the crampon has been rotated such that its back end 52 is downward and the front portion 54, with the front group 36 of teeth, is in contact with the surface of the harness plate 38. FIG. 6 shows the crampon 22 in side view, with bales 56 and 58 removed (shown in FIG. 3). The illustrated crampon is of a known configuration, marketed as the Sabre Tooth crampon by Black Diamond Equipt. Ltd. of Salt Lake City, Utah.

Figure 5:
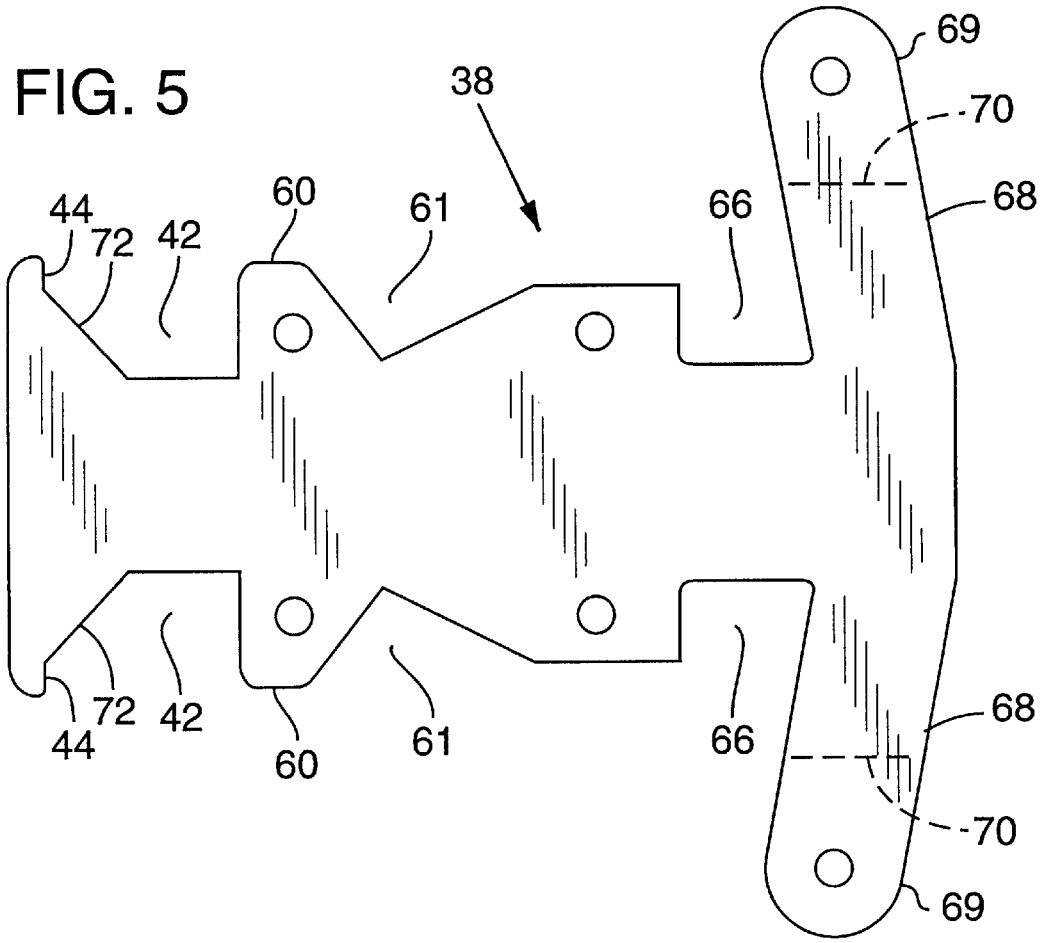
FIG. 5 is a plan view showing the plate of the harness assembly for the snowshoe of the invention.

FIG. 5 shows in plan, developed view the harness plate 38 which cooperates with the crampon 22. The clearance 42 at each side of the front end of the harness plate is shown as formed between the tip structure 44 and a wing extension 60 at each side, spaced back from the tips 44. The harness plate 38 is further configured to provide adequate spaces 61 for a further posterior pair of crampon teeth 62, still in the forward set 36 of teeth, as seen in FIGS. 3 and 6. Another pair of teeth 64, the most posterior of the forward set of teeth 36, are received in clearances 66 of the harness plate as shown in FIG. 5.

At the rear end of the harness plate 38 are a pair of arms 68, each of which has a tab 69 at its end, to be bent upward approximately at right angles along a line indicated by dashes 70 in FIG. 5. These tabs, as seen in FIG. 2, provide a mounting for the strap assembly 24 which extends over the user's boot after the user steps into the snowshoe with the crampon. The strap assembly 24 is adjustable, and preferably has a ratchet-type buckle known as a ladder lock buckle, of the type that tightens a strap by one or more notches in a rack of notches with each pivot stroke of a buckle lever, and which allows easy release by lifting the lever to a full-back position.

Figure 4:
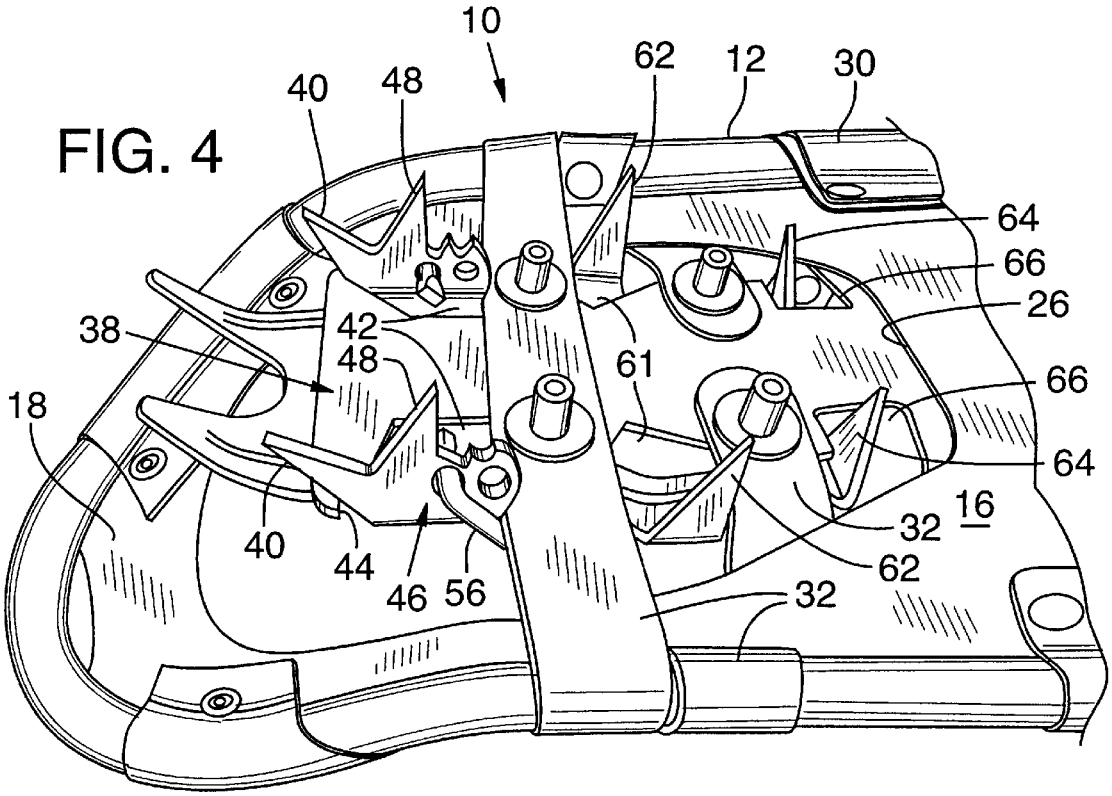
FIG. 4 is a perspective view showing the bottom side of the snowshoe's front harness assembly, with the crampon secured to the harness assembly.

FIG. 4, a bottom view of the snowshoe with the crampon attached, illustrates the engagement of the front end of the crampon with the snowshoe's harness assembly, and particularly with the harness plate 38. FIG. 4 reveals that the side protrusion 46 at each side of the crampon has been closely engaged within the clearance 42 at each side of the mounting plate 38. Also, the drawing shows the other pairs of teeth 62 and 64 as residing in the side clearances 61 and 66 of the harness plate. In this position the frame or deck 50 of the crampon is against the upper surface of the harness plate 38.

As can be appreciated from FIG. 4, the act of stepping into the front harness of the snowshoe with the crampon teeth 40 engaging as discussed above and shown in the drawings, locates the crampon precisely relative to the harness assembly and the snowshoe, establishing proper rotational orientation between the crampon and the snowshoe, such that the snowshoe is firmly secured to the crampon against left or right rotation. For this purpose, as shown in FIG. 5 and also seen in FIG. 4, the mounting plate 38 has angled surfaces 72 just aft of the tips 44, so that when the crampon teeth are inserted into and under the tips 44, these obliquely angled surfaces 72 guide the crampon into the precise position, particularly when the heel is rotated down to closely engage the crampon's side protrusions in the clearances 42.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

We claim:

1. A snowshoe and crampon combination, comprising:

a snowshoe including a snowshoe frame, a decking secured to the snowshoe frame, the decking providing an opening positioned substantially at the location of the heel of a user's boot when the snowshoe is worn by a user, and the snowshoe including a front harness assembly secured generally along a horizontal pivot to the frame and positioned to receive the toe of a user's foot, the front harness assembly including a plate having a predetermined shape, with open space surrounding the plate, a crampon with means for engagement with the user's boot and for securing the crampon to the boot, the crampon having a series of downwardly extending teeth, including a rear set of teeth positioned, when worn on a user's boot, to extend down through the opening in the snowshoe deck so as to engage terrain when so positioned and when the user's heel is pressed downwardly, the downwardly extending teeth of the crampon further including a front set of teeth so arranged to generally surround the plate of the harness assembly and to extend downwardly through said open space and beneath the plate to engage terrain when the crampon is engaged against the upper surface of the plate, and a front portion of the crampon and the plate of the harness assembly including cooperating means for locking the crampon in position on the plate of the harness assembly, whereby, the crampon may be worn on the user's boot for ice conditions, without the snowshoe, and when deep snow is to be traversed by the user, the boot and crampon can be secured directly to the snowshoe, the crampon thus providing cleats for the snowshoe.

2. The apparatus of claim 1, wherein the front harness assembly includes bias means urging the harness assembly toward a position wherein the rear end of the snowshoe is tipped downwardly relative to the user's boot.

3. The apparatus of claim 1, wherein the cooperating means for locking the crampon onto the plate comprises the front portion of the crampon having side protrusions extending downwardly and each including a tooth angled downwardly and forwardly, and the plate of the harness assembly defining limited clearances at left and right, just long enough to receive the side protrusions and the protrusions being configured such that the crampon can be engaged with the plate only by tipping the crampon in a toe-end-down position while engaging the angled teeth within said clearances at left and right of the plate, and such that the crampon becomes locked onto the plate by then rotating the heel end of the crampon down toward the snowshoe, positioning the angled front teeth edges under the plate and thus engaging the side protrusions in said limited clearances so that the crampon cannot be pulled directly upwardly from the plate.

4. The apparatus of claim 1, wherein the plate includes, aft of said cooperating means, pairs of opposed inward recesses positioned to receive pairs of opposed teeth of the crampon.

5. A snowshoe and crampon combination, comprising:

a snowshoe including a snowshoe frame and a decking secured to the snowshoe frame, the decking providing a heel crampon opening positioned substantially where the heel of a user's boot is located when the snowshoe is worn by a user, the snowshoe further including a crampon registry plate positioned substantially where a toe area of the user's boot is located when the snowshoe is worn by a user, with open space in the snowshoe decking around the registry plate, a crampon with means for engagement with the user's boot and for securing the crampon to the boot, the crampon having a series of downwardly extending teeth, including a rear set of teeth positioned, when worn on a user's boot, to extend down through the heel crampon opening in the snowshoe deck so as to engage terrain when the user's heel is pressed downwardly, the downwardly extending teeth of the crampon further including a front set of teeth so arranged to generally surround the crampon registry plate and to extend downwardly through said open space and beneath the plate to engage terrain when the crampon is engaged against an upper surface of the plate, and the registry plate and a front portion of the crampon including cooperating means for substantially locking the crampon in position on the registry plate against lateral movement and against relative twisting movement, whereby the crampon may be worn on the user's boot for ice conditions, without the snowshoe, and when deep snow is to be traversed by the user, the boot and crampon can be secured directly and securely to the snowshoe, the crampon thus providing cleats for the snowshoe.

6. The apparatus of claim 5, wherein the snowshoe further includes harness means connected to the snowshoe frame for engaging over the toe area of the user's boot.

7. The apparatus of claim 6, including a front harness assembly which includes the harness means, and which also includes bias means urging the harness assembly toward a position wherein the rear end of the snowshoe is tipped downwardly relative to the user's boot.

8. The apparatus of claim 5, wherein the cooperating means for locking the crampon onto the registry plate comprises the front portion of the crampon having side protrusions extending downwardly and each including a tooth angled downwardly and forwardly, and the registry plate defining limited clearances at left and right, just long enough to receive the side protrusions and the protrusions being configured such that the crampon can be engaged with the registry plate only by tipping the crampon in a toe-end-down position while engaging the angled teeth within said clearances at left and right of the plate, and such that the crampon becomes locked onto the plate by then rotating the heel end of the crampon down toward the snowshoe, thereby positioning the angled teeth edges under the plate and thus engaging the side protrusions in said limited clearances so that the crampon cannot be pulled directly upwardly from the plate and also substantially preventing lateral movement or twisting rotation of the crampon on the snowshoe.

9. A snowshoe and crampon combination, comprising:

a snowshoe including a snowshoe frame and a decking secured to the snowshoe frame, the decking providing a heel crampon opening positioned substantially where the heel of a user's boot is located when the snowshoe is worn by a user, a crampon with means for securing against the bottom of the user's boot, the crampon having a series of downwardly extending teeth, including a rear set of teeth positioned, when worn on a user's boot, to extend down through the heel crampon opening in the snowshoe deck so as to engage terrain when so positioned and when the user's heel is pressed downwardly, and including a front set of teeth positioned generally in a toe area of the user's boot, the snowshoe further including, at a position generally at the toe area of the user's boot, crampon locking means for cooperating with and registering with teeth of said front set of crampon teeth when said teeth are placed down into the crampon locking means so as to securely locate and register the crampon with the snowshoe, substantially fixing the crampon against lateral movement and against twisting movement relative to the snowshoe, and the snowshoe decking including space adjacent to the crampon locking means to allow the front set of crampon teeth to extend down through the snowshoe to engage terrain, whereby the crampon may be worn on the user's boot for ice conditions, without the snowshoe, and when deep snow is to be traversed by the user, the boot and crampon can be secured directly and securely to the snowshoe, the crampon thus providing cleats for the snowshoe.

* * * * *